US009932721B2

(12) United States Patent
Vigholm et al.

(10) Patent No.: US 9,932,721 B2
(45) Date of Patent: Apr. 3, 2018

(54) SYSTEM, WORKING MACHINE COMPRISING THE SYSTEM, AND METHOD OF SPRINGING AN IMPLEMENT OF A WORKING MACHINE DURING TRANSPORT

(75) Inventors: Bo Vigholm, Stora Sundby (SE); Andreas Ekvall, Hallstahammar (SE)

(73) Assignee: Volvo Construction Equipment AB, Eskilstuna (SE)

( * ) Notice: Subject to any disclaimer, the term of this patent is extended or adjusted under 35 U.S.C. 154(b) by 810 days.

(21) Appl. No.: 12/741,421

(22) PCT Filed: Nov. 21, 2007

(86) PCT No.: PCT/SE2007/001030

§ 371 (c)(1),
(2), (4) Date: May 5, 2010

(87) PCT Pub. No.: WO2009/067052

PCT Pub. Date: May 28, 2009

(65) Prior Publication Data

US 2010/0268410 A1 Oct. 21, 2010

(51) Int. Cl.
*E02F 9/22* (2006.01)
*E02F 9/26* (2006.01)

(52) U.S. Cl.
CPC ..... *E02F 9/2217* (2013.01); *E02F 9/2207* (2013.01); *E02F 9/2296* (2013.01);
(Continued)

(58) Field of Classification Search
CPC .. F15B 1/021; F15B 21/008; F15B 2211/212; F15B 2211/329; F15B 2211/3058;
(Continued)

(56) References Cited

U.S. PATENT DOCUMENTS 5,577,876 A * 11/1996 Haeder ..... B60K 28/04 180/273
6,648,308 B2 * 11/2003 Gunnar Rothoff ..... 267/64.17
(Continued)

FOREIGN PATENT DOCUMENTS

EP 0378129 A1 7/1990
JP 6330535 A 11/1994
(Continued)

OTHER PUBLICATIONS

International Search Report for corresponding International Application PCT/SE2007/001030.
(Continued)

*Primary Examiner* — Florian M Zeender
*Assistant Examiner* — Milena Racic
(74) *Attorney, Agent, or Firm* — WRB-IP LLP

(57) ABSTRACT

A system for a working machine is adapted for springing the movement of a load during transport and includes at least one hydraulic cylinder for operating the load, an accumulator, and a valve adapted to control a flow communication between the hydraulic cylinder and the accumulator. The system includes a first control valve arranged on a conduit connecting to the piston side of the hydraulic cylinder, a second control valve arranged on a conduit connecting to the piston rod side of the hydraulic cylinder, a first pressure sensor for detecting a load pressure of the hydraulic cylinder, a second pressure sensor for detecting a charge pressure of the accumulator, and a control unit adapted to receive signals with information about the pressures detected by the pressure sensors and to generate control signals corresponding to the detected pressures for controlling the springing function.

14 Claims, 2 Drawing Sheets

(52) U.S. Cl.
CPC ..... *E02F 9/265* (2013.01); *F15B 2211/30565* (2013.01); *F15B 2211/3144* (2013.01); *F15B 2211/5059* (2013.01); *F15B 2211/625* (2013.01); *F15B 2211/6309* (2013.01); *F15B 2211/6313* (2013.01); *F15B 2211/8616* (2013.01)

(58) Field of Classification Search
CPC ..... F15B 2211/30525; F15B 2211/528; F15B 13/021; B66F 9/22
USPC ..... 701/29; 60/418, 469, 420, 422; 267/64.17; 172/812–831; 414/685; 137/254; 37/234, 382, 414–416
See application file for complete search history.

(56) References Cited

U.S. PATENT DOCUMENTS 6,655,136 B2 * 12/2003 Holt ..... E02F 9/2207 60/414
7,194,856 B2 * 3/2007 Ma ..... E02F 9/2207 60/418
7,204,185 B2 * 4/2007 Ma ..... F15B 11/006 91/446
7,857,070 B2 * 12/2010 Harber ..... E02F 9/2004 172/2
2005/0011190 A1 1/2005 Bitter
2006/0266027 A1 11/2006 Ma et al.
2007/0056277 A1 3/2007 Mizoguchi et al.

FOREIGN PATENT DOCUMENTS

JP 9041428 A 2/1997
JP 2005155230 A 2/1997
WO 9916981 A1 4/1999
WO 2006107242 A1 10/2006

OTHER PUBLICATIONS

International Preliminary Report on Patentability for corresponding International Application PCT/SE2007/001030.
European Search Report (dated Sep. 6, 2016) for corresponding European App. EP07852057.

* cited by examiner

SYSTEM, WORKING MACHINE COMPRISING THE SYSTEM, AND METHOD OF SPRINGING AN IMPLEMENT OF A WORKING MACHINE DURING TRANSPORT

BACKGROUND AND SUMMARY

The present invention relates to a system for a working machine, wherein the system is adapted for springing the movement of a load during transport. The system comprises at least one hydraulic cylinder for operating the load, an accumulator, and a valve adapted to control a flow communication between the hydraulic cylinder and the accumulator. In particular, the invention relates to a working machine comprising the system.

The invention further relates to a method of springing an implement of a working machine during transport.

Below, the invention will be described in connection with the operation of a working machine in the form of a wheel loader. This is a preferred, but by no means limiting application of the invention. The invention can also be used for other types of working machines (or work vehicles), such as a backhoe loader, an excavator, or an agricultural machine such as a tractor.

When the implement of the wheel loader (for example a bucket or pallet forks) is brought into contact with a load and lifts it, the implement is preferably rigidly connected to the frame of the wheel loader. During transport of the load, however, particularly over an uneven ground surface, it is advantageous that the implement can move (sway) relative to the frame. In this way, the comfort of the operator is increased and material spillage from the implement during transport is reduced. For this reason, wheel loaders are equipped with load arm suspension. In a load arm suspension, the lift cylinders of the working machine are brought into flow communication with an accumulator. Thereby, the load arm becomes movable relative to the frame. The result is two movable masses instead of one.

In a loading cycle, usually an automatic activation and deactivation of the load arm suspension is used. For example, a gear dependent activation can be used, which means that the load arm suspension is active all the time except with the 1st front gear. The 1st gear is activated immediately before the bucket is pushed into the material (rocks, gravel, etc), and thereby the load arm suspension is deactivated. When the wheel loader reverses from the material after this, the reverse gear is activated and thereby the load arm suspension is activated once again.

WO 99/16981 discloses a load arm suspension system. The system comprises an accumulator which can be brought into flow communication with a piston side of the lift cylinders. The system further comprises a tank for hydraulic fluid which can be brought into flow communication with a piston rod side of the lift cylinders. The system comprises a plurality of valves for controlling the suspension. The system, and particularly the valves, is designed in such a way that pressure equalization between the piston side of the lift cylinders and the accumulator is performed automatically before the load arm suspension is activated. In this way, the previously occurring pitch movements of the implement when activating the load arm suspension are avoided to a large extent.

According to prior art, the damping characteristic is usually constant (that is to say non-variable) and thus has to be adjusted for operation with either an empty bucket, a full bucket, or to an intermediate position, which means that the damping characteristic does not become optimal for other load cases.

When lifting extremely heavy pallet loads according to prior art, there is a risk that a dumping movement of the assembly occurs, causing the pallet to hit the ground. The reason for this is that the accumulator does not have time for sufficient charging during the short phase before activation takes place.

Furthermore, when activating a load-arm suspension according to prior art, there is a risk of a thump in the machine when the valve controlling the flow communication between the hydraulic cylinder and the accumulator is opened.

Furthermore, when activating a load arm suspension according to prior art, there is a risk that the accumulator is charged to pressure which is too high, which results in energy losses when the accumulator is drained to tank. This problem is particularly pronounced during short-cycle loading, when the loading (and thereby the charging) is performed at a high frequency (two to three times per minute).

It is desirable to achieve a system which provides springing of the movement of the implement during transport and which creates prerequisites for a flexible and, from an energy point of view, efficient operation. More particularly, the invention seeks to create prerequisites for solving at least one of the above mentioned problems.

According to an aspect of the present invention, a system comprises a first control valve arranged on a conduit connecting to the piston side of the hydraulic cylinder, a second control valve arranged on a conduit connecting to the piston rod side of the hydraulic cylinder, a first pressure sensor for detecting a load pressure of the hydraulic cylinder, a second pressure sensor for detecting a charge pressure of the accumulator, and a control unit adapted to receive signals with information about the pressures detected by the pressure sensors and to generate control signals corresponding to the detected pressure for controlling the springing function.

In this way, the damping characteristic can be varied, for example, depending on the load case. During transport with an empty bucket, a softer, that is to say more undamped, movement is desired than during transport of a heavy load (when a relatively stiff suspension is desired). The damping characteristic can be varied, for example, by controlling the opening degree of the valve, which controls the flow communication between the hydraulic cylinder and the accumulator, based upon detected pressure levels.

Before activation takes place, pressure equalization has to be performed, in order not to get uncontrolled movements when activating the suspension. Thus, the accumulator should be brought to substantially the same pressure level as the one the lift cylinder (the piston side) has before it is connected. Thanks to the fact that the system comprises pressure sensors for detecting a load pressure of the hydraulic cylinder and a charge pressure of the accumulator, the suspension can be activated when the pressure in the accumulator is within a determined window (offset) compared to the lift cylinder. This accordingly means that a limited uncontrolled up or down movement is allowed.

Thanks to the fact that the system comprises pressure sensors for detecting a load pressure of the hydraulic cylinder and a charge pressure of the accumulator, the suspension can be activated according to determined, variable methods, depending on whether the pressure in the accumulator is lower or higher than the pressure in the lift cylinder.

When automatic activation and deactivation of the load arm suspension is concerned, the invention creates prerequisites for reducing the activation time. According to prior art, the load arm suspension can be deactivated when the pressure in the accumulator is low (empty bucket) and activated when the pressure in the lift cylinder is high. A large quantity of oil must then be filled into the accumulator and the time for activation can become long. One way of reducing this time is to sneak-fill oil into the accumulator to a certain specific pressure level when lifting takes place.

Furthermore, with this system a limit can be set on the maximum pressure in the accumulator. The control unit registers the pressure in the accumulator via its associated pressure sensors. When this pressure has reached a specific level, the control unit closes the valve which is connected to the accumulator. This can be used in order to increase the service life of the accumulator or, alternatively, to reduce the complexity, and thereby the cost, of the accumulator.

Furthermore, the arrangement with the first and second control valve offers large possibilities for controlling the activation of the suspension in an optimal way. In particular, it is not necessary to connect the pump and tank simultaneously to the lift function. The first and the second control valve are used together for lifting the load and lowering the load, respectively. Accordingly, the lift function is double-acting. The first control valve and the second control valve are actuatable independently of each other.

The hydraulic system is preferably load-sensing. This means that the pump detects the pressure (a LS signal) from the activated hydraulic cylinders. The pump then sets a pressure which is a certain number of bar higher than the pressures of the cylinders. This brings about an oil flow out to the control cylinders, the level of which depends upon how much the activated control valve is adjusted.

A second object of the invention is to achieve a corresponding method which provides springing of the movement of the implement during transport, and which creates prerequisites for a flexible and, from an energy point of view, efficient operation.

This is achieved by means of a method comprising the steps of detecting a charge pressure of the accumulator and a load pressure of the hydraulic cylinder, and controlling activation of the springing function based upon the detected pressures.

This object is also achieved by means of a method comprising the step of controlling a damping of the movement of the implement by variably controlling the opening degree of a valve adapted to control a flow communication between the hydraulic cylinder and an accumulator.

Further preferred embodiments of the invention and advantages associated therewith are apparent from the following description.

BRIEF DESCRIPTION OF FIGURES

The invention will be described more closely in the following, with reference to the embodiments shown in the attached drawings, wherein.

DETAILED DESCRIPTION

Figure 1:
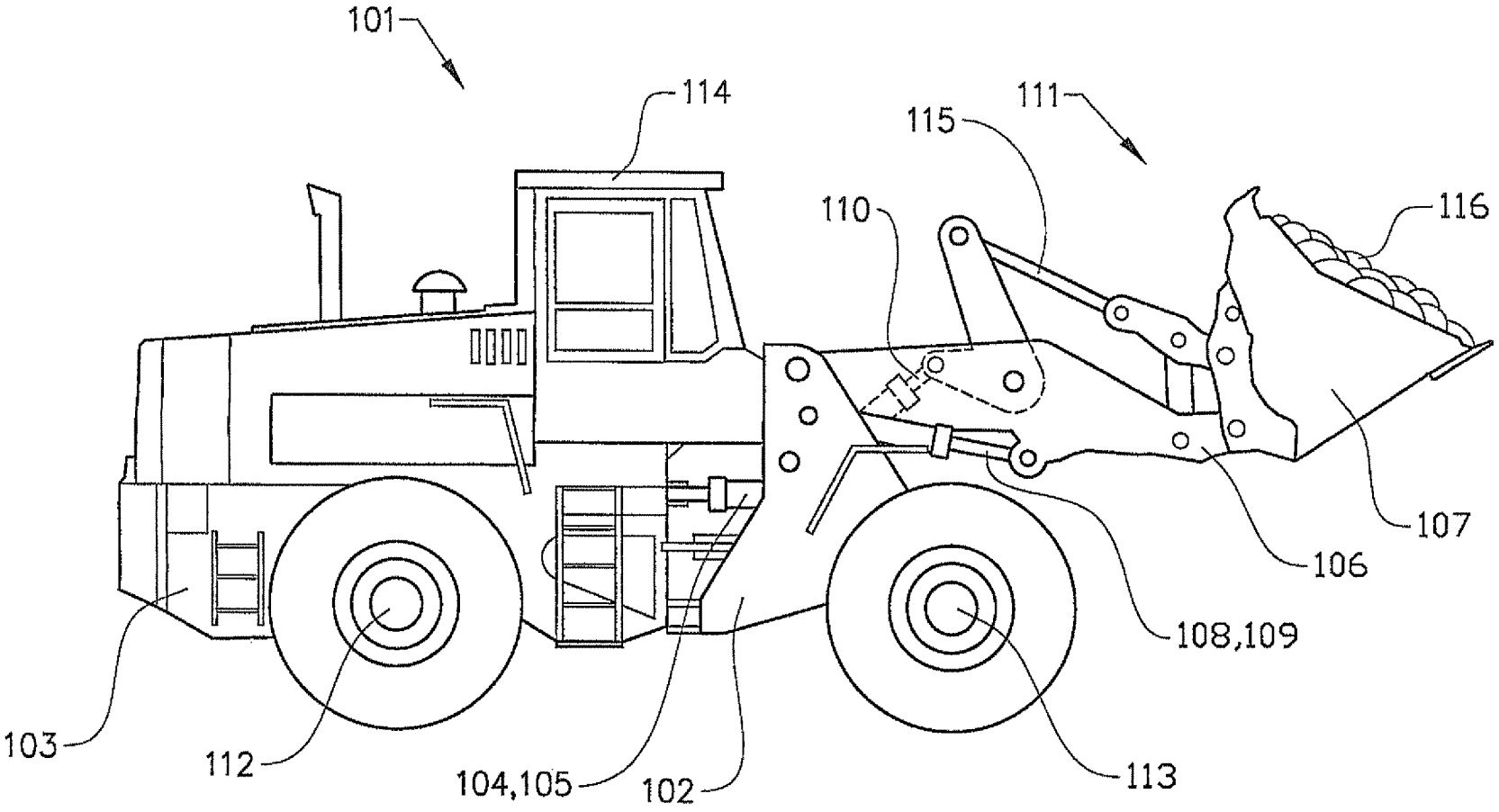
FIG. 1 shows a side view of a wheel loader.

FIG. 1 shows a side view of a wheel loader 101. The wheel loader 101 comprises a front vehicle section 102 and a rear vehicle section 103, said sections each comprising a frame and a pair of drive shafts 112, 113. The rear vehicle section 103 comprises an operator's cab 114. The vehicle sections 102, 103 are connected to each other in such a way that they can be pivoted relative to each other about a vertical axis by means of two hydraulic cylinders 104, 105 which are connected to the two sections. Accordingly, the hydraulic cylinders 104, 105 are disposed on different sides of a centre line in the longitudinal direction of the vehicle for steering, or turning the wheel loader 101.

The wheel loader 101 comprises an equipment 111 for handling objects or material. The equipment 111 comprises a load-arm unit 106 and an implement 107 in the form of a bucket which is fitted on the load-arm unit. Here, the bucket 107 is filled with material 116. A first end of the load-arm unit 106 is pivotally connected to the front vehicle section 102 in order to achieve a lifting movement of the bucket. The bucket 107 is pivotally connected to a second end of the load-arm unit 106 in order to achieve a tilting movement of the bucket.

The load-arm unit 106 can be raised and lowered relative to the front section 102 of the vehicle by means of two hydraulic cylinders 108, 109, each of which is connected at one end to the front vehicle section 102 and at the other end to the load-arm unit 106. The bucket 107 can be tilted relative to the load-arm unit 106 by means of a third hydraulic cylinder 110, which is connected at one end to the front vehicle section 102 and at the other end to the bucket 107 via a link arm system.

Figure 2:
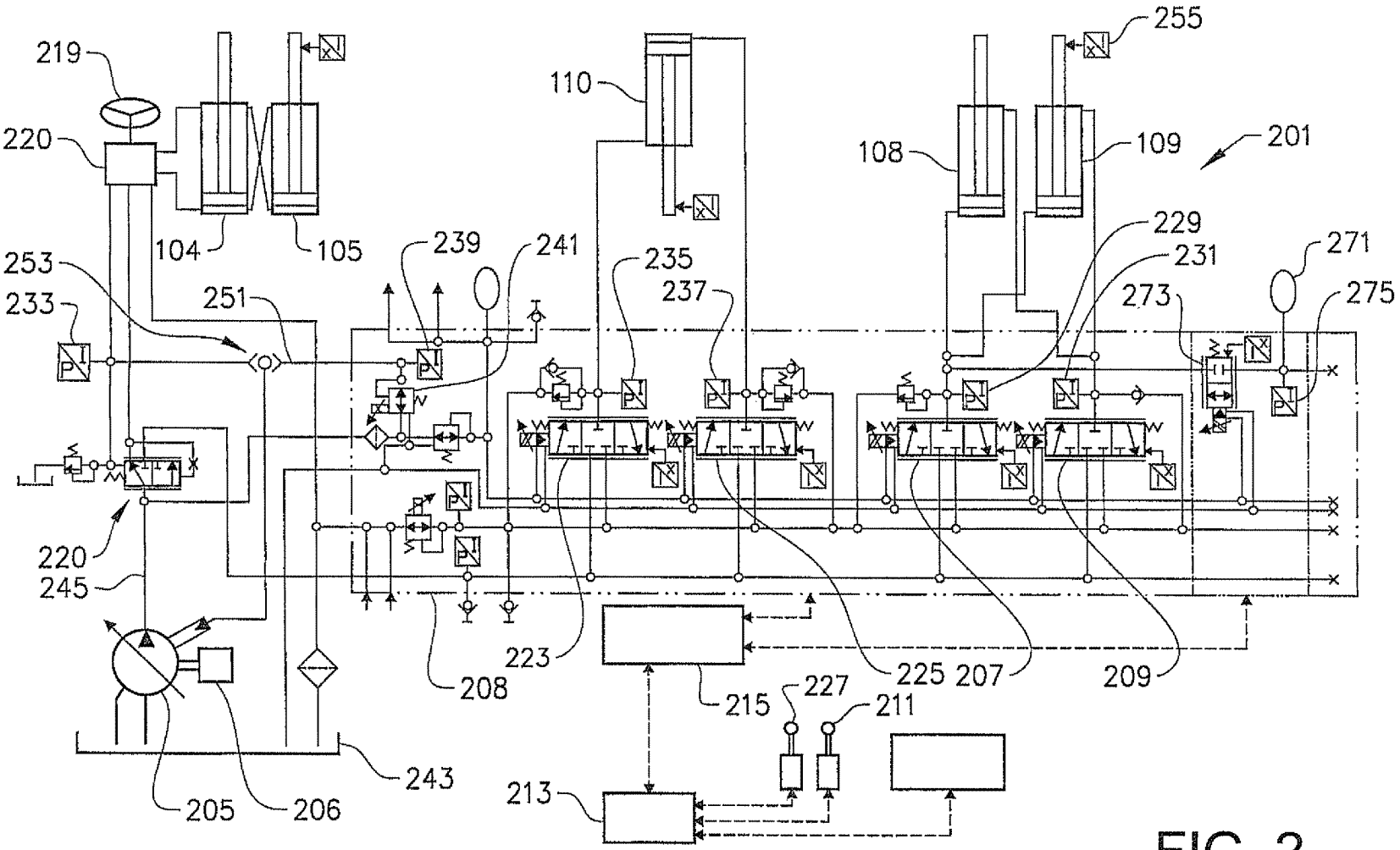
FIG. 2 shows an embodiment of a system for the wheel loader.

A first embodiment of the system is shown in FIG. 2. The system 201 comprises a pump 205 adapted to supply the hydraulic cylinders with pressurized hydraulic fluid via a hydraulic circuit. The pump 205 is driven by the vehicle's propulsion engine 206, in the form of a diesel engine. The pump 205 has a variable displacement. The pump 205 is preferably adapted for infinitely variable control. The system 201 comprises a valve device 208 (se the dash-dotted line) which comprises a hydraulic circuit having a plurality of control valves for controlling the lift and tilt function.

Two control valves, in the form of flow valves, 207, 209, are arranged between the pump 205 and the lift cylinders 108, 109 in the circuit in order to control the lifting and lowering movement. While a first one of these valves 207 is arranged to connect the pump 205 to the piston side, a second one of these valves 209 is arranged to connect a tank 243 to the piston rod side. Furthermore, the first valve 207 is arranged to connect the tank 243 to the piston side and, correspondingly, the second valve 209 is arranged to connect the pump 205 to the piston rod side. This offers large possibilities for varying the control. In particular, it is not necessary to connect the pump and tank simultaneously to the function.

The system 201 further comprises a control unit 213, or computer, which contains software for controlling the functions. The control unit is also called a CPU (central processing unit) or ECM (electronic control module). The control unit 213 suitably comprises a microprocessor.

An operator-controlled element 211, in the form of a lift lever, is operatively connected to the control unit 213. The control unit 213 is adapted to receive control signals from the control lever and to actuate the control valves 207, 209 correspondingly (via a valve control unit 215). The control unit 213 preferably controls more general control strategies and the control unit 215 controls basic functions of the valve unit 208. Naturally, the control units 213, 215 can also be integrated into a single unit. When controlling the pump 205, there is an oil flow out to the cylinders 108, 109, the level of which depends on the extent to which the activated valves 207, 209 are adjusted.

An operator-controlled element 219, in the form of a steering-wheel, is hydraulically connected to the steering cylinders 104, 105, via a valve unit in the form of an orbitrol unit 220, for direct-control thereof.

Similarly as for the lift function, two control valves 223, 225 are arranged between the pump 205 and the tilt cylinder 110 for controlling the forward and return movement of the implement relative to the load-arm unit. An operator-controlled element 227, in the form of tilt lever, is operatively connected to the control unit 213. The control unit 213 is adapted to receive control signals from the tilt lever and to actuate the control valves 223, 225 correspondingly.

A prioritizing valve 220 is arranged on the outlet conduit 245 of the pump for automatically prioritizing that the steering function receives the required pressure before the lift function (and the tilt function).

The system 201 is load sensing and comprises, for this purpose, a plurality of pressure sensors 229, 231, 233, 235, 237 for detecting load pressures of each of said functions. The lift function of the system comprises two pressure sensors 229, 231, out which one is arranged on a conduit to the piston side of the lift cylinders and the other on a conduit to the piston rod side of the lift cylinders. In a corresponding way, the tilt function of the system comprises two pressure sensors 235, 237, out of which one is arranged on a conduit to the piston rod side of the tilt cylinder and the other on a conduit to the piston side of the tilt cylinder. The steering function comprises a pressure sensor 233 on a conduit connected to the steering cylinders 104, 105. More precisely, the pressure sensor 233 is situated on the LS conduit which receives the same pressure as on one cylinder side when steering in one direction and as on the other cylinder side when steering in the other direction. In neutral, the LS conduit is connected to tank.

The system further comprises an electrically controlled valve 241 adapted to control the output pressure of the pump via a hydraulic signal. The system 201 comprises an additional pressure sensor 239 for detecting a pressure which is indicative of an output pressure from the pump. More precisely, the pressure sensor 239 is adapted to detect the pressure in a position downstream the electrically controlled valve 241. Accordingly, the pressure sensor 239 senses the pump pressure directly when the valve 241 is fully open. In normal operating conditions, the pressure sensor 239 senses the modulated pressure from the valve 241. Accordingly, the control unit 213 is adapted to receive a signal from the pump pressure sensor 239 with information about the pressure level.

Accordingly, the control unit 213 receives electrical signals from the pressure sensors 229, 231, 233, 235, 237, 239 and generates an electrical signal for actuating the electrical valve 241.

As previously stated, the control unit 213 is adapted to receive signals from the control levers 211, 227. When the operator desires to lift the bucket, the lift lever 211 is operated. The control unit receives a corresponding signal from the lift lever 211 and actuates the control valves 207, 209 to such a position that the pump is connected to the piston side of the lift cylinders 108, 109 and the piston rod side of the lift cylinders is connected to the tank 243. Furthermore, the control unit receives signals from the load pressure sensor 229 on the piston side of the lift cylinders and from the pressure sensor 239 downstream the pump. Based upon the received signals, a desired pump pressure at a level above the detected load pressure is determined, and the electrically controlled pump control valve 241 is actuated correspondingly.

The control unit 213 is preferably adapted to coordinate the opening degree of the control valves 207, 209 and the output pressure of the pump 205 for optimum operation.

The tilt function is controlled in a corresponding manner as the lift function. When steering the machine, the pressure sensor 233 of the steering function detects a steering load pressure and generates a corresponding load signal. The control unit 213 receives this load signal and a signal from the pressure sensor 239 on the outlet conduit of the electrically controlled valve 241. Based upon the received signals, a desired pump pressure at a level above the detected load pressure is determined, and the electrically controlled pump control valve 241 is actuated correspondingly.

When several functions are used simultaneously, the detected load pressures are compared and the pump 205 is controlled corresponding to the largest one of the detected load pressures.

Accordingly, the electrically controlled pump control valve 241 is adapted to be infinitely adjustable between two end positions, a first end position which corresponds to the pump generating a minimum pressure and a second end position which corresponds to the pump generating a maximum pressure.

A hydraulic means 253, in the form of a reversing valve, is arranged on a conduit 251 between the electrically controlled pump control valve 241 and the pump. The reversing valve 253 is adapted to receive the hydraulic signals from the steering function and the pump control valve 241. Furthermore, the reversing valve is adapted to control the pump 205 corresponding to the received signal having the largest load pressure. Accordingly, the hydraulic means (reversing valve) 253 selects the higher pressure in an output signal made up of two input pressure signals.

The system further comprises a sensor 255 for detecting lift cylinder position. The sensor 255 is operatively connected to the control unit 213. In this way, the control unit 213 can determine whether a lifting or lowering movement of the load is performed.

The system 201 further comprises an accumulator 271 (or several accumulators) adapted for springing the load-arm and thereby the implement 106 during transport, and a valve 273 adapted to control a flow communication between the lift cylinders 108, 109 and the accumulator 271. The system further comprises a pressure sensor 275 for detecting a charge pressure of the accumulator 271. The control unit 213 is adapted to receive signals with information about the load pressure in the lift cylinders 108, 109 via its associated pressure sensors 229 and the charge pressure in the accumulator 271 via the pressure sensor 275, and to generate control signals corresponding to the detected pressures for controlling the springing function.

More precisely, the valve 273 between the lift cylinders 108, 109 and the accumulator 271 is adapted to control a flow communication between the piston side of the lift cylinders and the accumulator. This valve 273 is electrically controlled.

A number of different examples of control of the springing method, and particularly of control during the activation thereof, will follow below. When "the piston side" and "the piston rod side" are mentioned below, they refer to the piston side and piston rod side, respectively, of the lift cylinders, if nothing else is stated.

Before activation takes place, pressure equalization is performed, that is to say the accumulator 271 should be at substantially the same pressure level as the piston side before it is connected. The purpose of this is to avoid getting uncontrolled movements during connection.

According to one example, the pressure equalization is controlled based upon accepting a certain pressure difference tolerance between the accumulator 271 and the piston side.

If the pressure in the accumulator 271 is within a predetermined window, or interval (offset), relative to the piston side, the load-arm suspension is activated. This means that a limited, uncontrolled up or down movement of the implement is allowed. According to a first alternative, this pressure offset is equal in both directions. According to a second alternative, the pressure offset is different in different directions. For example, a larger upward movement can be allowed. According to a third alternative, the pressure offset is a function of a detected operating parameter, such as the pressure level on the piston side. The higher the pressure is, the larger an offset can be allowed, since a larger differential pressure is required at a high pressure, as compared to at a low pressure, in order to obtain the same oil volume from the accumulator. In the end, this would result in the same movement offset for different loads.

According to a further example, the load arm suspension is activated only when the lift function is in neutral.

If the pressure in the accumulator is lower than on the piston side, the following takes place according to a first alternative: The control unit 213 checks whether a lifting or lowering movement is in progress (for example via the lift lever 211). If it is in progress, activation is postponed until the lift function is in neutral. The control unit then checks the pressure level on the piston side and stores this in the memory (for example 100 bar). Via the control unit, the pump 205 is then set at a pressure level which is higher than the pressure level on the piston side (for example 130 bar) by the electrical load sensing system.

The valve 207, connecting the pump 205 to the piston side, is opened. In this situation, this valve 207 acts like a pressure reducing valve, that is to say, it ensures that the pressure on the piston side always remains within a certain offset higher than the pressure stored in the memory (for example 120 bar), which means that the load-arm cannot fall down.

The valve 273 is opened and admits oil into the accumulator. The opening of the valve 273 to the accumulator is preferably done with a certain time ramp. The extent to which the valve 273 is opened depends on the pressure level on the piston side. A check of the pressure level on the piston side is performed so that it does not fall below a certain level, that is to say a certain level above the pressure stored in the memory (for example 110 bar). When the pressure in the accumulator 271 is substantially the same as it was on the piston side (for example within a certain offset according to the foregoing) before pressurization was started, the valve 207, controlling the pump side to the piston side, is closed. Accordingly, the load sensing signal to the pump 205 is interrupted. Thereafter, the second control valve 209, connecting the piston rod side to tank 243, is opened. The valve 273, controlling the flow communication between the piston side and the accumulator 271, remains open. Thereby, the load arm suspension is activated.

If the pressure in the accumulator is lower than on the piston side, the following takes place according to a second alternative: The control unit 213 checks whether a lifting or lowering movement is in progress (for example via the lift lever 211). If it is in progress, activation is postponed until the lift function is in neutral. Via the control unit 213, the pump 205 is then set at a pressure level which is higher than the pressure level on the piston side by the electrical load sensing signal (for example 130 bar if the load pressure is 100 bar).

Pressurization of the piston side also causes a pressurization of the piston rod side. If the load in the bucket suddenly becomes larger (while the activation is in progress), an unintentional lowering of the load-arm can occur, but this can be registered from the pressure dropping to zero on the piston rod side. In order to prevent this, the valve 207 between the pump 205 and the piston side continuously adjusts the pressure on the piston side so that the pressure on the piston rod side never falls below a certain level. This means that the valve 207, controlling the flow communication between the pump 205 and the piston side, acts like a pressure reducing valve, that is to say, it ensures that the pressure on the piston rod side is always at a certain specific level (for example 20 bar), which means that there is a sufficient pressure on the piston side and that, consequently, the load-arm cannot fall down.

Thereafter, the valve 273, connecting the piston side to the accumulator 271, is opened and admits oil into the accumulator. The opening of the valve 273 to the accumulator 271 is preferably done with a certain time ramp. The opening degree of the valve 273 is controlled depending on the pressure on the piston rod side. The pressure level on the piston rod side is checked so that it does not fall below a certain specific level (for example 10 bar). When the pressure in the accumulator 271 is equal to the pressure on the piston side (or with a certain offset below this level, see above), the valve 207, controlling the feed side of the pump to the piston side, is closed. Accordingly, the load sensing signal to the pump 205 is interrupted. The valve 209, connecting the piston rod side to tank, is opened. The valve 273 to the accumulator 271 remains open. Thereby, the load-arm suspension is activated.

If the accumulator pressure is higher than the pressure on the piston side, the following takes place according to a first alternative: The control unit 213 checks whether a lifting or lowering movement is in progress. If it is in progress, activation is postponed until the function is in neutral. The control unit 213 checks the pressure level on the piston side and stores it in the memory. The valve 273 to the accumulator 271 is opened. Thereafter, the pressure is drained via the valve 207 connecting the piston side to the tank 243 (acts like a pressure limiter), until the pressure reaches the same level as the pressure stored in the memory (or a certain offset above, see the example above). Thereafter, the valve 207, connecting the piston side to tank, is closed. Thereafter, the valve 209, connecting the piston rod side to the tank 243, is opened. Thereby, the load-arm suspension is activated.

If the accumulator pressure is higher than the pressure on the piston side, the following takes place according to a second alternative. The control unit 213 checks whether a lifting or lowering movement is in progress. If it is in progress, activation is postponed until the function is in neutral. The valve 273 to the accumulator is opened. The pressure on the piston rod side will then be increased, since the pressure in the accumulator 271 was higher than on the piston side. Thereafter, the pressure is drained from the piston side via the valve 207, connecting the piston side to the tank 243 (the valve acts like a pressure limiter), until the pressure on the piston rod side reaches a certain specific level (e.g. 10 bar). Thereafter, the valve 207, connecting the piston side to tank, is closed. The valve 209, connecting the piston rod side to tank, is opened. Thereby, the load-arm suspension is activated.

According to a further alternative, the load-arm suspension is activated simultaneously while a lifting or lowering movement is in progress. The valve 273 between the piston side and the accumulator 271 is opened with a certain time ramp to a certain flow level, in such a way that the load-arm suspension is connected without causing any noticeable disturbances to the operator. The time ramp and the opening degree can have the following dependencies: According to a first example, they are constant regardless of operating condition. According to a second example, they are dependent on the pressure difference between the piston side and the accumulator. According to a third example, they are dependent on the speed of the function (the higher the speed is, the less the by-pass to the accumulator is noticed). The above examples can also be combined.

According to a further example, the accumulator is pre-filled (sneak-filled) with oil to a certain pressure level before activation takes place, with the purpose of reducing the activation time. The control unit 213 checks that the load-arm suspension is deactivated and that lifting is in progress. If the pressure on the piston side is higher than in the accumulator, filling of the accumulator is initiated, that is to say, the valve 273 to the accumulator 271 is opened to a certain degree. This opening degree can have the following dependencies: According to a first example, the opening degree is constant regardless of operating condition. According to a second example, the opening degree is dependent on the pressure difference between the piston side and the accumulator 271. According to a second example, the opening degree is dependent on the speed of the lift function (the higher the speed is, the less the by-pass to the accumulator is noticed).

The filling of the accumulator 271 is done up to the lowest pressure level of the following: the pressure level on the piston side or a determined maximum pressure. This maximum pressure can have the following dependencies: According to a first example, the maximum pressure is constant regardless of operating condition. According to a second example, the maximum pressure is equal to the one the accumulator had at the previous activation, or an average of a number of previous activations or a certain offset from this value.

The accumulator 271 can be likened to a spring, where the gas pre-charging corresponds to the biasing of the spring. The damping in the system originates from frictions in the load-arm joints and in the cylinder, and pressure drops over the valve 273 leading to the accumulator in which flow goes back and forth. This means that the spring characteristic (the accumulator) is fixed. The damping, on the other hand, can be changed by varying the opening degree of the valve. This means that the pressure drop when flow goes back and forth is changed.

The control strategy for the opening degree (damping) of the valve can be performed according to the following alternatives: According to a first example, the opening degree is constant regardless of operating condition. According to a second example, the opening degree is dependent on the pressure difference between the piston side and the accumulator. More precisely, the larger the pressure difference is, the smaller the opening degree will be. This means that more energy is consumed at higher flows between the piston side and the accumulator. Especially with an empty bucket, problems with too little movement in the load-arm usually arise, since the frictions in joints and cylinder become so large in relation to the force exerted by the masses, which means that the damping of the valve should be kept low (the valve be opened up).

According to a first example, the opening degree is dependent on the pressure level in the cylinder. This means that the damping becomes smaller, the smaller the load is. This is advantageous, especially in the low load range where frictions in the load-arm and cylinder are dominating. According to a second example, the opening degree is a function of handling operation or implement. In certain handling operations, a stiffer system is desired and in other ones a somewhat softer one, that is to say, more or less damping. One example of a handling operation is loading of timber on a truck. Thereby, it is desirable to avoid bending the support legs of the truck. In that case, it is advantageous with a stiffer setting. According to a third example, the opening degree is a function set by the operator. Different operators will drive in different ways, and are in some cases accustomed to a certain characteristic from other machines. According to a fourth example, the opening degree is a function of the position of the implement or the cylinder positions. A stiffer system is advantageous if the bucket is close to the ground surface, in order to prevent the bucket from swaying and digging into the ground surface. A softer system is advantageous when the bucket is in a high position, in order to reduce the risk of tip-over.

According to an alternative, or supplement, the damping characteristic can be adjusted via the valve 209, connecting the piston rod side to the tank 243, and can have the same type of dependencies as described in the foregoing.

The invention should not be regarded as limited to the above-described exemplary embodiments, but a number of further variants and modifications are conceivable within the scope of the following claims.

In the foregoing description, the term "electrically controlled valve" has been used for a directly electrically actuated valve on a hydraulic conduit, that is to say, the valve is adapted to be actuated via an electrical input signal. There are, of course, variants of this which fall within the scope of the term "electrically controlled valve", such as an assembly of several valves, out of which a first valve is arranged on the hydraulic conduit, and a second, directly electrically actuated, valve is adapted to actuate the first valve via a hydraulic signal.

The invention claimed is:

1. System for a working machine, wherein the system is configured to spring the movement of a load during transport, wherein the system comprises at least one hydraulic cylinder for operating the load, an accumulator, a pump configured to supply the hydraulic cylinder with pressurized hydraulic fluid via one of a first control valve and a second control valve, which pump is controllable via an electrical signal, wherein the first control valve is arranged on a conduit connecting to the piston side of the hydraulic cylinder, which first control valve is configured to control a flow communication between the pump and a piston side of the hydraulic cylinder, the second control valve is arranged on a conduit connecting to a piston rod side of the hydraulic cylinder, the second control valve being configured to control a flow communication between a tank and the piston rod side of the hydraulic cylinder, a valve configured to control a flow communication between the piston side of the hydraulic cylinder and the accumulator, the valve being connected to a conduit portion fluidly connecting the first control valve to the piston side of the hydraulic cylinder such that, when the valve is open, a fluid communication path is provided between the piston side of the hydraulic cylinder and the accumulator, which fluid communication path does not pass through the first control valve, a first pressure sensor for detecting a load pressure of the hydraulic cylinder, a second pressure sensor for detecting a charge pressure of the accumulator, and a control unit configured to receive signals with information about the pressures detected by the pressure sensors and to generate control signals corresponding to the detected pressures for controlling a springing function by means of the accumulator by allowing fluid communication between the piston side of the hydraulic cylinder and the accumulator via the valve and also allowing fluid communication between the piston rod side of the hydraulic cylinder and the tank via the second control valve, and for controlling the first, control valve in order to achieve a pressure equalization between the accumulator and the piston side of the hydraulic cylinder before the springing function is activated.

2. System according to claim 1, wherein the system comprises an electrically controlled valve configured to control the output pressure of the pump via a hydraulic Signal, and that the control unit is configured to actuate the electrically controlled valve corresponding to the load pressure of the hydraulic cylinder.

3. System according to claim 1, wherein the second control valve is configured to control a flow communication between the piston rod side of the hydraulic cylinder and a tank.

4. System according to claim 1, wherein the first control valve and the second control valve are actuatable independently of each other.

5. System according to claim 1, wherein the valve between the hydraulic cylinder and the accumulator is configured to control a flow communication between the piston side of the hydraulic cylinder and the accumulator.

6. System according to claim 1, wherein the valve, configured to control the flow communication between the hydraulic cylinder and the accumulator, is electrically actuated.

7. System according to claim 1, wherein the system comprises means for detecting whether a lifting or lowering movement of the load is performed.

8. System according to claim 1, wherein the first pressure sensor is configured for detecting a load pressure on the piston side of the hydraulic cylinder.

9. System according to claim 1, wherein a third pressure sensor is configured for detecting a pressure on the piston rod side of the hydraulic cylinder, and that the control unit is configured to receive signals with information about the pressure detected by the pressure sensor and to generate control signals corresponding to the detected pressure for controlling the springing function.

10. System according to claim 1, wherein the control unit is configured to generate control signals to at least one of the valves for controlling the springing function.

11. System according to claim 1, wherein the system is load sensing.

12. Working machine, wherein it comprises a system according to claim 1.

13. Working machine, in the form of a wheel loader, comprising a system according to claim 1.

14. System according to claim 1, wherein the second pressure sensor is arranged such that the second pressure sensor can detect the charge pressure of the accumulator irrespective of a current condition of the valve.

* * * * *